US007159729B2

(12) United States Patent
Sabold et al.

(10) Patent No.: US 7,159,729 B2
(45) Date of Patent: Jan. 9, 2007

(54) RIB TRUSS FOR CONTAINER

(75) Inventors: Bret Sabold, Bernville, PA (US); Angie Noll, York, PA (US); Paul Kelley, Thurmont, MD (US)

(73) Assignee: Graham Packaging Company, L.P., York, PA (US)

( * ) Notice: Subject to any disclaimer, the term of this patent is extended or adjusted under 35 U.S.C. 154(b) by 73 days.

(21) Appl. No.: 10/814,632

(22) Filed: Apr. 1, 2004

(65) Prior Publication Data

US 2005/0218107 A1 Oct. 6, 2005

(51) Int. Cl.
*B65D 1/46* (2006.01)

(52) U.S. Cl. ..... 215/382; 215/384; 220/669; 220/675

(58) Field of Classification Search ..... 215/382, 215/383, 384, 398; 220/669, 675
See application file for complete search history.

(56) References Cited

U.S. PATENT DOCUMENTS

| | | | | | |
|---|---|---|---|---|---|
| D193,637 | S | * | 9/1962 | Ferraro | D9/556 |
| D213,421 | S | * | 3/1969 | Leary | D9/538 |
| D218,020 | S | * | 7/1970 | Musson | D9/538 |
| D316,968 | S | * | 5/1991 | York | D9/551 |
| 5,092,475 | A | | 3/1992 | Krishnakumar et al. | |
| 5,201,438 | A | * | 4/1993 | Norwood | 220/666 |
| 5,224,614 | A | * | 7/1993 | Bono et al. | 215/384 |
| 5,261,543 | A | * | 11/1993 | Ugarelli | 215/375 |
| D366,416 | S | | 1/1996 | Semersky | |
| D366,417 | S | | 1/1996 | Semersky | |
| D366,831 | S | | 2/1996 | Semersky et al. | |
| 5,499,730 | A | * | 3/1996 | Harbour | 215/382 |
| 5,732,838 | A | * | 3/1998 | Young | 215/384 |
| D395,008 | S | * | 6/1998 | Kuzma et al. | D9/538 |
| 5,758,790 | A | * | 6/1998 | Ewing, Jr. | 215/384 |
| 5,762,221 | A | | 6/1998 | Tobias et al. | |
| 6,016,932 | A | | 1/2000 | Gaydosh et al. | |
| 6,095,360 | A | * | 8/2000 | Shmagin et al. | 215/382 |
| 6,161,713 | A | * | 12/2000 | Krich | 215/384 |
| 6,213,326 | B1 | * | 4/2001 | Denner et al. | 215/383 |
| 6,257,433 | B1 | | 7/2001 | Ogg et al. | |
| 6,550,627 | B1 | * | 4/2003 | Elich et al. | 215/384 |
| 2001/0037992 | A1 | * | 11/2001 | Tanabe et al. | 215/384 |
| 2002/0158038 | A1 | * | 10/2002 | Heisel et al. | 215/382 |

* cited by examiner

*Primary Examiner*—Sue A. Weaver
(74) *Attorney, Agent, or Firm*—Venable, LLP; Keith G. Haddaway; Jeffri A. Kaminski

(57) ABSTRACT

A container is disclosed. The container may be a hot-fill container having an improved geometry. The container may comprise a base, a body portion attached to the base and a concave waist attached to the body portion and having a surface. The surface including a plurality of axial apexes and troughs alternately arranged around the waist. A dome may be attached to the waist. A finish may be attached to the dome, the finish having an opening.

12 Claims, 3 Drawing Sheets

RIB TRUSS FOR CONTAINER

BACKGROUND OF THE INVENTION

1. Field of the Invention

The present invention relates generally to a blow-molded plastic container designed to package beverages hot-filled into the container, and more particularly to a blow-molded container that is able to withstand the internal pressures and external forces exerted on the container during packaging, transporting, and handling.

2. Related Art

Blow-molded plastic containers are commonplace in packaging beverages and other liquid, gel, or granular products. Studies indicate that the configuration and overall aesthetic appearance of a blow-molded plastic container can affect some consumer purchasing decisions. For instance, a dented, distorted, or otherwise unaesthetic appearing container may provide the basis for some consumers to purchase a different brand of product that is packaged in a more aesthetically pleasing manner.

While a container in its as-designed configuration may provide an appealing appearance when it is initially removed from blow-molding machinery, many forces act subsequently on, and distort the as-designed configuration before the container is placed on the shelf. Plastic containers are particularly susceptible to distortion because they are continually being re-designed in an effort to reduce the amount of plastic required to make the container. This reduction of plastic can decrease container rigidity and structural integrity.

In the packaging of beverages, especially juice, blow-molded plastic polyethylene terephthalate (PET) containers are used in the so-called "hot-fill" process. The "hot-fill" process comprises filling the containers with liquid at an elevated temperature, sealing the containers, and then allowing the liquid to cool. As a result of "hot fill" processing, internal forces (e.g., changes of pressure and temperature) act on the container and may cause distortion of the container. Therefore, hot-fillable plastic containers must provide sufficient flexure to compensate for these changes, while maintaining structural integrity and aesthetic appearance. The flexure is most commonly addressed with vacuum flex panels positioned under a label below the dome.

In addition to internal forces acting on the container, external forces may also be applied to sealed containers as they are packed and shipped. Filled containers are typically packed in bulk in cardboard boxes, or plastic wrap, or both. A bottom row of packed filled containers is likely to support several upper tiers of filled containers, and potentially, several upper boxes of filled containers. Therefore, it is important that the containers have a top loading capability that is sufficient to prevent distortion from the intended container shape.

The containers have exhibited a limited ability to withstand top loading during filling, capping and stacking for transportation. Overcoming these problems is important because it would decrease the likelihood of a container's top or shoulder being crushed, as well as inhibiting ovalization in this area. It is important to be able to stack containers so as to maximize the use of shipping space. Due to the weight of liquid-filled containers, the boxes often need reinforcing such as egg crate dividers to prevent crushing of the containers. The vulnerability of the containers to crushing can be increased by the deformation resulting from the above-mentioned vacuum.

A particular problem which can result from the hot-filling procedure is a decrease in the container's ability to withstand top loading during filling, capping and labeling. Because of the decreased container rigidity immediately after filling and after cooling, even heat set containers are less able to resist loads imparted through the top or upper portion of the container, such as when the containers are stacked one upon the other for storage and shipping. Top loads are imparted to the container when it is dropped and lands on the upper portion or mouth of the container. As a result of this top loading, the container can become deformed and undesirable to the consumer.

Dome region ovalization is a common distortion associated with hot-fillable, blow-molded plastic containers. The dome is the upper portion of the container adjacent to the finish. Some dome configurations are designed to have a horizontal cross-section that is circular in shape. The forces resulting from hot-filling and top loading can change the intended horizontal cross-section shape, for example, from circular to oval.

An example of hot-fillable, blow-molded plastic containers that can withstand the above-referenced forces and can maintain their as-designed aesthetic appearance are the containers disclosed in U.S. Pat. Nos. 5,762,221, D.366,416, D.366,417, and D.366,831 all assigned to the assignee of the present application. The referenced utility patent discloses a "bell-shape" dome located between a finish and label mounting area which controls the degree of dome deformation due to hot-filling and resists dome deformation due to top loading. The dome comprises stiffening structures formed by inwardly concave grooves that provide a degree of reinforcement against distortion of the dome. The referenced design patents illustrate in phantom lines a similar "bell-shape" dome whose diameter of the horizontal cross-section increases as the dome extends downwardly from the finish. The dome diameter then decreases into an inwardly extending peripheral waist, and downwardly from the waist, the dome diameter increases before connecting with the label mounting area of the container. The bell-shape of the dome provides an aesthetic appearance as initially blow-molded, and it also provides a degree of reinforcement against distortion of the dome, particularly ovalization types of distortion.

Containers of the above type have exhibited a limited ability to withstand top loading during filling, capping and stacking for transporting of the containers. Overcoming these problems is important because it would decrease the likelihood of a container's top or shoulder being crushed, as well as inhibiting ovalization in this area. Obviously, it is important to be able to stack containers so as to maximize the use of shipping space. It also enhances the ability to lightweight the container.

Embodiments of the present invention in contrast, allow for increased flexing of the vacuum panel sidewalls so that the pressure on the containers may be more readily accommodated. Additionally, the container is provided with a more circular cross-section that can increase an internal volume of the container and allow for a wide variety of labeling options.

SUMMARY OF THE INVENTION

In an exemplary embodiment of the present invention, a container is disclosed. The container may be a hot-fill container having an improved geometry. The container may comprise a base, a body portion attached to the base and a concave waist attached to the body portion and having a surface. The surface includes a plurality of axial apexes and troughs alternately arranged around the waist. A dome may be attached to the waist. A finish may be attached to the dome, the finish having an opening.

In another embodiment, the container comprises a finish and a dome attached to the finish. The dome extends from the finish to a first ridge having a first diameter. A body has a second ridge with a second diameter. A reduced diameter portion connects the first ridge and the second ridge. The reduced diameter portion has a surface comprised of a plurality of panels. The panels have side edges connected to side edges of an adjacent panel and are alternately inclined and declined with respect to each other around the reduced diameter portion.

In another embodiment, a container comprises a finish and a top portion extending from the finish and generally increasing to a first diameter. An undulating surface is connected to the top portion and extends around at least a portion of a circumference of the container. A body portion has a second diameter and is connected to the undulating surface.

In another embodiment, a container comprises a finish and a dome attached to the finish. The dome extends from the finish to a first ridge having a first diameter. A body has a second ridge with a second diameter. A reduced diameter portion connects the first ridge and the second ridge. A truss structure is disposed in the reduced diameter portion, the truss structure being arranged continuously around a circumference of the container.

Further features and advantages of the invention, as well as the structure and operation of various embodiments of the invention, are described in detail below with reference to the accompanying drawings.

BRIEF DESCRIPTION OF THE DRAWINGS

The foregoing and other features and advantages of the invention will be apparent from the following, more particular description of a preferred embodiment of the invention, as illustrated in the accompanying drawings.

DETAILED DESCRIPTION OF AN EXEMPLARY EMBODIMENT OF THE PRESENT INVENTION

A preferred embodiment of the invention is discussed in detail below. While specific exemplary embodiments are discussed, it should be understood that this is done for illustration purposes only. A person skilled in the relevant art will recognize that other components and configurations can be used without parting from the spirit and scope of the invention.

Figure 1:
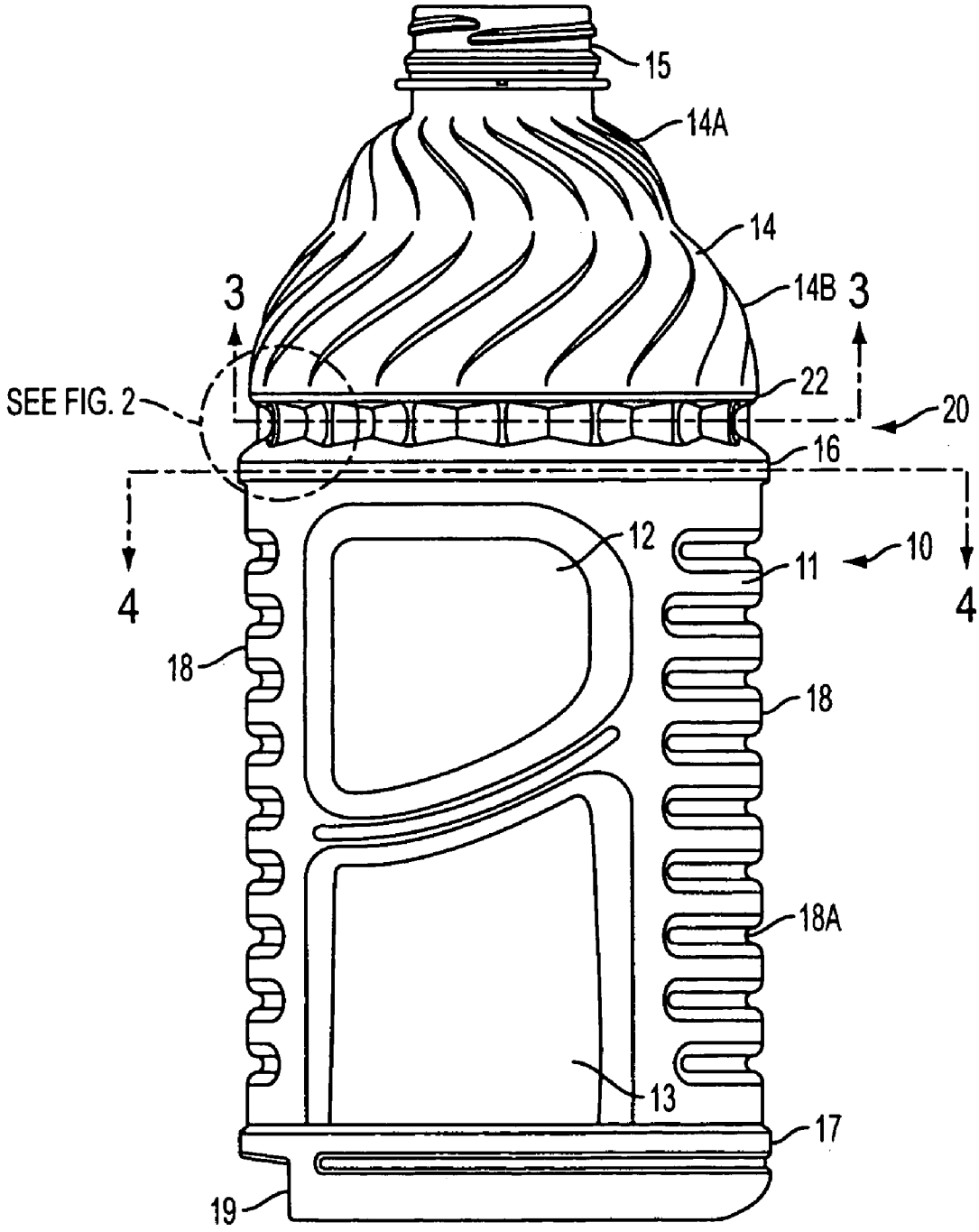
FIG. 1 depicts an isometric view of an exemplary embodiment of a container according to the present invention.

Referring now to the drawings, FIG. 1 illustrates a grippable container 10 which is particularly suited for hot fill applications. As best seen therein, the container 10 has a body portion 11, which may be of tubular cross section, such as cylindrical or rectangular, having a plurality of spaced grips or vacuum panels, such as the panels 12 and 13. The body portion 11 of the container 10 has an upper label bumper 16 and a lower label bumper 17 both of which may extend continuously about the periphery of the body portion 11. The vacuum panels 12 and 13 are located between the label bumpers 16 and 17 for accommodating vacuum induced shrinkage resulting from liquid contraction due to the hot fill process. Thus, the term vacuum induced volumetric shrinkage as used herein refers to such shrinkage, and not to inherent thermally induced volumetric shrinkage.

Upper label bumper 16 and a lower label bumper 17 are upper and lower limits for label mounting areas 18. Upper label bumper 16, label mounting areas 18 and lower label bumper 17 provide surfaces for labels to be affixed with, for example, glue to container 10. In this example, flexible panels 12, 13 are provided outside label mounting areas 18 to provide strength and/or to accommodate volumetric changes to a hot-fill container after it has been sealed and as it cools. In other embodiments, flexible panels can be provided within label mounting areas such that labels cover the flexible panels. Ribs 18A may be provided in in the label mounting areas 18 or at other locations on the container.

A suitable base 19 is provided below the lower label bumper 17. The base 19 may be of conventional construction having appropriate reinforcing ribs, such as radial ribs, to provide the desired stiffness and anti-inverting capabilities preferred for a hot fill container, as well known in the art.

The container 10 has a dome portion 14 superposed on the body portion 11. The dome portion 14 has a conventional flanged finish 15 with threads adapted to receive a cap. The dome portion 14 has an upper section 14*a* adjacent to finish 15 and a lower section 14*b* superjacent the upper label bumper 16. The dome portion 14 lies within a cylindrical plane extending upwardly tangent to the upper label bumper 16. Other designs are also possible within the scope of the invention, for example a design without a defined upper and lower portion.

The dome 14, as illustrated, has a bell-shaped profile and a substantially circular horizontal cross-section. To this end, the horizontal cross-section through the dome 14, starting from beneath the finish 15, increases in diameter as it extends toward the base 19.

The dome portion 14 and the body 11 may be unitarily formed with one another in what is referred to as the waist region 20. The waist region 20 can generally be described as a circumferential recess or annular groove formed between the lower periphery of the dome portion 14 and the upper periphery of the body 11. The waist region 20 may extend around the entire circumference of the container or only partially around the container. Waist 20 generally has a smaller cross-sectional area than does a lower portion of dome 14. Below waist 20 is upper label bumper 16. The waist region 20 may also be disposed at other locations, such as within the body 11.

The embodiment of dome 14 shown in FIG. 1 has a larger cross-sectional area at its lower extremity than does the smallest portion of waist 20. In this example, dome 14 has its maximum cross-sectional area at this lowest point. This point is represented as first ridge 22 having a first diameter. Also, dome 14 is generally circular in cross section, with the diameter of the cross section becoming smaller as the distance from waist 20 increases. This reduction in diameter produces an inwardly sloping dome as one moves toward finish 15.

Figure 2:
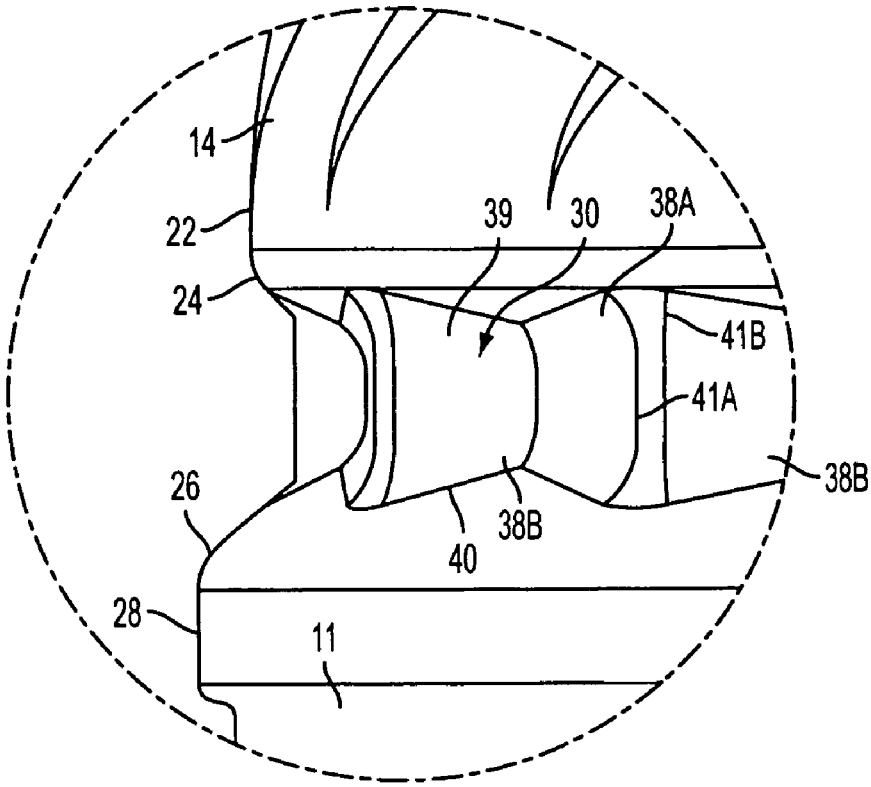
FIG. 2 depicts a detailed side view of an exemplary embodiment of a container according to the present invention.

FIG. 2 provides a more detailed view of the waist region 20. The waist region 20 may unitarily connect the dome portion 14 to the body portion 11. The lower periphery of the dome portion 14 transitions inwardly and downwardly into an surface portion 24. The upper periphery of the body 11 transitions into an inwardly and upwardly extending surface portion 26. The body portion 11 includes a second ridge 28 having a second diameter. The waist region 20 may comprise a concave surface extending between the surface portions 24, 26. The first diameter of the first ridge 22 may be smaller than the second diameter of the second ridge 28.

Figure 4:
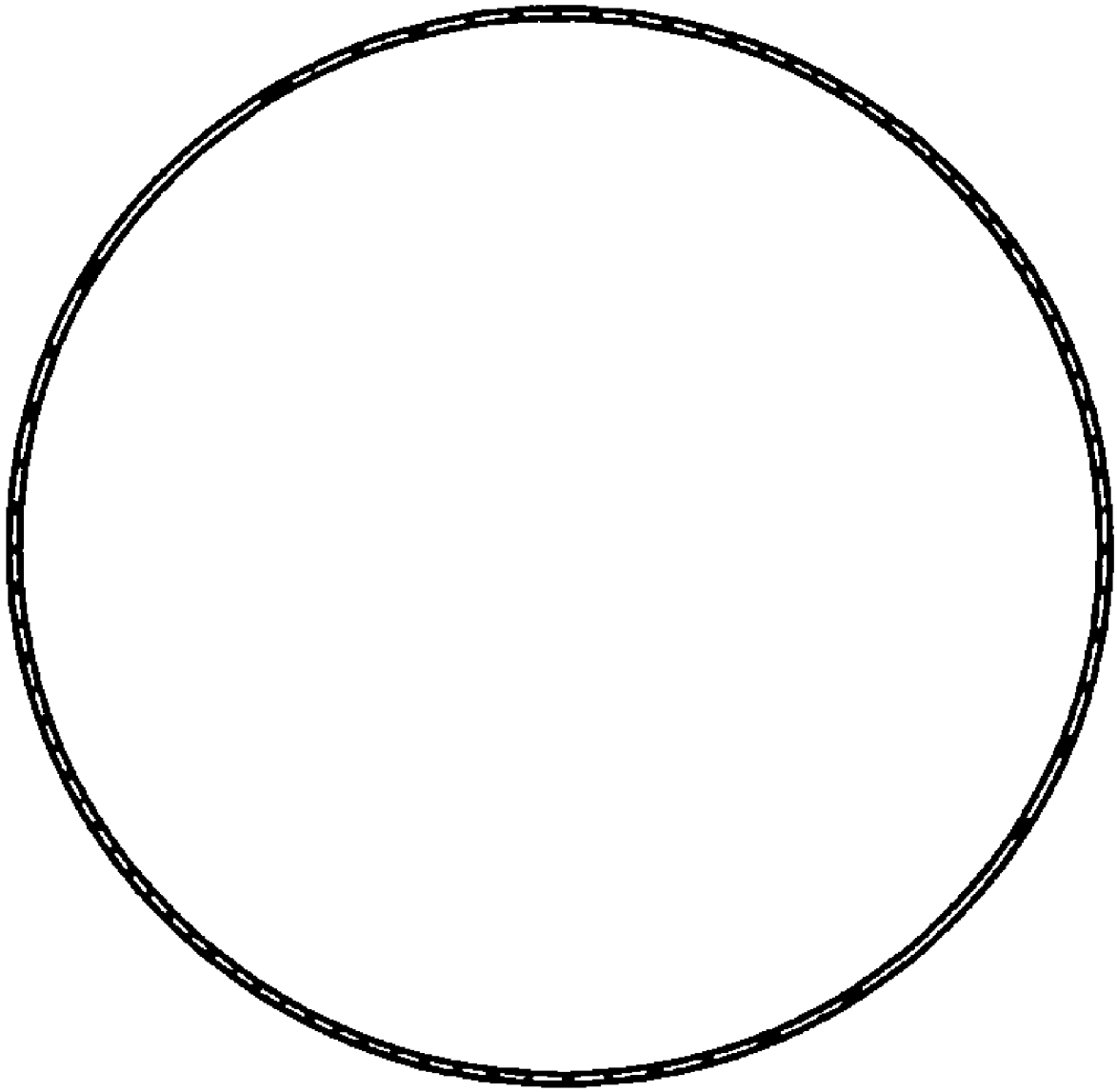
FIG. 4 is a cross-section of an exemplary embodiment of the present invention.

A truss structure 30 may be formed within the waist region 20 as shown in the figures. The truss structure may laterally bisect a concave surface extending between first and second ridges 22, 28. Alternatively, the truss structure may also be formed in other areas of the container, for example in ribs 18A. In the embodiment illustrated, the truss structure may generally be 20–40% thicker than the first and second ridges 22, 28, as shown in FIG. 4 but not thicker than the overall container in average. Additionally, the truss structure may take forms other than that shown in the preferred embodiments. The truss structure should be delimited by the surface portions 24, 26, that is, the truss structure preferably does not extend beyond surface portions 24, 26. The truss structure may be comprised of structural members or surface features that provide structural support to the container 10. The truss structure should improve the hoop strength of the waist region 20 and maintain the top load strength of the container 10. The truss structure may be recessed with respect to the first ridge 22 and the second ridge 28. The truss structure may also be arranged continuously around the circumference of the container 10.

Figure 3:
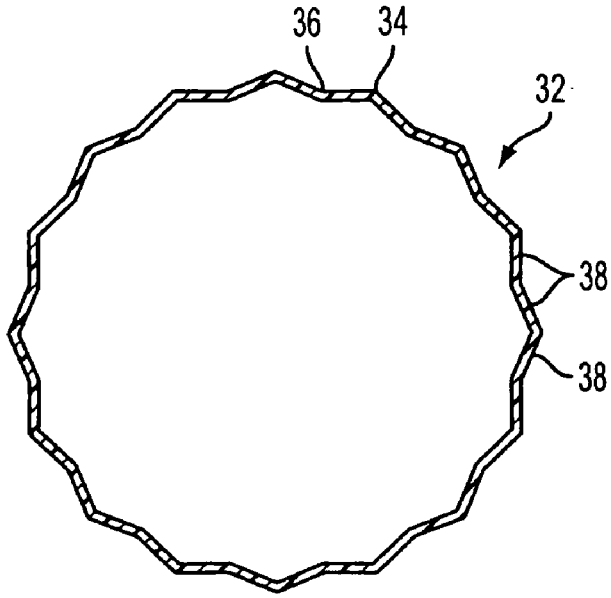
FIG. 3 is a cross-section of an exemplary embodiment of the present invention.

The truss structure may take many different forms. In the embodiment illustrated, the truss structure includes an undulating surface in the waist region. The undulating surface is best seen in FIG. 3. The undulating surface 32 may extend around the entire circumference of the container 10. The undulating surface 32 includes peaks 34 and troughs 36 that extend axially in the waist region. Each of the peaks 34 and troughs 36 are recessed toward an inside of the container with respect to the first ridge 22 and the second ridge 28.

The truss structure 30 may also comprise a plurality of panels 38 repeatedly cut into the confines of the waist region 20. The panels 38 may have a substantially rectangular trapezoidal shape with a top side 39, a bottom side 40, and two side edges 41A, 41B. Of course, the panels may have other shapes. The top side 39 of the panel 38, is adjacent to the surface portion 24. The bottom side 40 of the panel 38 is adjacent to the surface portion 26. The panels 38 are preferably arranged end to end around the circumference of the container 10. Each side edge 41A, 41B of a panel is connected to a side edge 41A, 41B of an adjacent panel. The peaks 34 and troughs 36 may be formed at the connection between adjacent panels. For example, panels 38A and 38B are arranged adjacent to each other. Side edge 41A of panel 38A is connected to side edge 41B of panel 38B. The junction of side panels 38A, 38B forms a peak.

As mentioned above the truss structure may take other forms. For example, the panels 38 may be sinusoidal, arced, curved etc. The peaks 34 and troughs 36 may be straight or arced and their intersection may be angular or rounded. The number of peaks and troughs, their relatinal angles and relative depths may vary from container to container.

FIG. 3 illustrates a cross-section taken along section 3—3 of FIG. 1. The panels may be alternately arranged to incline and decline around the circumference of the container 10. The panels connect the peaks and troughs to form a generally zigzag shape around a circumference of the container. Each panel has one side edge that forms a part of a peak and the other side edge which forms part of a trough. Two adjacent panels form a substantially V-shape with a trough formed at the connection between the adjacent panels. The panels are arranged to alternately incline and decline, depending on the direction of travel, around the circumference of the container 10. The truss structure may comprise a repeating pattern formed around the circumference of the container 10.

Accordingly, an improved container is provided. A container using the disclosed has several advantages over known containers. For example, the truss structure may provide increased hoop strength, ovalization resistance, and improved top load strength.

While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. A container, comprising:

a base;

a body portion attached to the base;

a concave waist attached to the body portion and having a surface, the surface including a plurality of axial apexes and troughs alternately arranged around the waist and configured to improve hoop strength of the waist and to maintain top load strength;

a first ridge and a second ridge arranged on either side of the waist, the apexes and the troughs of the surface being recessed with respect to both of the first and second ridges, the surface being 20%–40% thicker than the ridges;

a dome attached to the waist; and a finish attached to the dome, the finish having an opening.

2. The container of claim 1, further comprising a first surface portion extending inwardly and downwardly from the dome to the waist;

a second surface portion extending inwardly and upwardly from the body to the waist.

3. The container of claim 1, wherein the waist unitarily connects the body and dome.

4. The container of claim 1, the first ridge has a diameter that is less than equal to or greater than a diameter of the second ridge.

5. The container of claim 1, further comprising panels connecting the apexes and trough, the panels arranged end to end.

6. The container of claim 5, wherein each panel has one end connected at an apex and one end connected at a trough.

7. A container, comprising:

a finish;

a dome attached to the finish, the dome extend from the finish to a first ridge having a first diameter;

a body having a second ridge with a second diameter;

a reduced diameter portion connecting the first ridge and the second ridge, the reduced diameter portion having a surface comprised of a plurality of panels, the panels being 20%–40% thicker than the first and second ridges and having side edges adjacent to side edges of an adjacent panel and being alternately inclined and declined with respect to each other around the reduced diameter portion.

8. The container of claim 7, wherein one side edge of a side panel forms an apex and the other side edge of the panel forms part of a trough.

9. The container of claim 7 wherein a first diameter of the first ridge is less than, greater than or equal to a second diameter of the second ridge.

10. A container, comprising:

a finish;

a dome attached to the finish, the dome extend from the finish to a first ridge;

a body having a second ridge;

a reduced diameter portion connecting the first ridge and the second ridge;

a truss structure disposed in the reduced diameter portion, the truss structure being arranged continuously around at least a portion of a circumference of the container and being 20–40% thicker than the first and second ridges.

11. The container of claim 10, wherein the truss comprises a plurality of panels, the panels having side edges adjacent to side edges of an adjacent panel and being alternately inclined and declined with respect to each other around the reduced diameter portion.

12. The container of claim 10, wherein the truss structure includes a surface having a plurality of axial apexes and troughs alternately arranged around the circumference of the reduced diameter portion.

* * * * *